US006950079B2

(12) United States Patent
Inoue

(10) Patent No.: US 6,950,079 B2
(45) Date of Patent: Sep. 27, 2005

(54) LIGHT EMITTING DIODE DRIVING CIRCUIT

(75) Inventor: Takao Inoue, Kawagoe (JP)

(73) Assignee: Pioneer Corporation, Tokyo (JP)

( * ) Notice: Subject to any disclaimer, the term of this patent is extended or adjusted under 35 U.S.C. 154(b) by 202 days.

(21) Appl. No.: 10/060,398

(22) Filed: Feb. 1, 2002

(65) Prior Publication Data

US 2002/0105487 A1 Aug. 8, 2002

(30) Foreign Application Priority Data

Feb. 5, 2001 (JP) ..... 2001-027776

(51) Int. Cl.[7] ..... G09G 3/14
(52) U.S. Cl. ..... 345/46; 345/82
(58) Field of Search ..... 345/82, 84, 102, 345/103, 211; 315/159, 128, 200 A; 323/349; 347/237; 340/815.45, 912; 361/106; 363/89

(56) References Cited

U.S. PATENT DOCUMENTS 3,787,752 A * 1/1974 Delay ..... 327/544
4,358,713 A * 11/1982 Senoo et al. ..... 315/291
5,068,570 A * 11/1991 Oda et al. ..... 315/128
5,097,145 A * 3/1992 Hayashi ..... 327/109
5,345,167 A * 9/1994 Hasegawa et al. ..... 323/349
5,426,446 A * 6/1995 Takei et al. ..... 345/82
5,457,450 A * 10/1995 Deese et al. ..... 340/912
5,661,645 A * 8/1997 Hochstein ..... 363/89
5,783,909 A * 7/1998 Hochstein ..... 315/159
5,850,126 A * 12/1998 Kanbar ..... 315/200 A
5,936,620 A * 8/1999 Komine et al. ..... 345/211
5,978,009 A * 11/1999 Fujikura ..... 347/237
6,075,233 A * 6/2000 Kato ..... 250/205
6,111,739 A * 8/2000 Wu et al. ..... 361/106
6,236,331 B1 * 5/2001 Dussureault ..... 340/815.45
6,858,994 B2 * 2/2005 Vollrath ..... 315/200 A

FOREIGN PATENT DOCUMENTS

DE 33 39 391 A1 5/1985
DE 100 13 208 A 1 9/2001
JP 56-36718 4/1981
JP 2-247688 10/1990
JP 6-77534 3/1994
JP 10-135520 5/1998
JP 11-109919 4/1999

OTHER PUBLICATIONS

European Search Report dated Sep. 24, 2002.
European Search Report dated May 23, 2002.

* cited by examiner

*Primary Examiner*—Chanh Nguyen
(74) *Attorney, Agent, or Firm*—McGinn & Gibb, PLLC

(57) ABSTRACT

A luminance control circuit has luminance change characteristics similar to those of a conventional lamp when a light emitting diode is used as a light source. The luminance control circuit adjusts the value of a forward current flowing in the light emitting diode in accordance with a control voltage which is obtained by smoothing a light adjustment pulse signal from an illuminance control circuit. The circuit has: a pulse adjustor for adjusting a duty factor of the light adjustment pulse signal according to characteristics of the light emitting diode; holding circuit for holding the control voltage to a predetermined value or more; and a switch for interrupting the forward current flowing in the light emitting diode by using the light adjustment pulse signal or a pulse signal after the adjustment of the duty factor, wherein at least two of these three elements are used in combination.

21 Claims, 5 Drawing Sheets

LIGHT EMITTING DIODE DRIVING CIRCUIT

BACKGROUND OF THE INVENTION

1. Field of the Invention

The invention relates to a control circuit for adjusting the luminance of a light emitting diode by using a pulse signal.

2. Description of Related Art

Hitherto, it was general to use lamps as a light source for illuminating a console panel or the like of a vehicle. The luminance of the lamp is adjusted by a PWM (Pulse Width Modulation) signal (hereinafter, simply referred to as a pulse signal) which is supplied from a so-called illuminance control circuit. Specifically, the pulse signal from the illuminance control circuit is smoothed, a DC voltage included in the pulse signal is extracted, and a constant voltage circuit for driving the lamp is controlled by the DC voltage, thereby making a luminance adjustment of the lamp.

Since lamps are used as light source, there are problems that the electric current consumption is large, a large-size transistor has to be used in the constant voltage circuit for driving the lamps, so that it is difficult to miniaturize the luminance adjusting circuit as a whole. There also is a problem of a short lamp life due to a failures such as breakage of the filament. A further drawback is that it is difficult to obtain the maximum luminance of the lamp. Therefore, in recent years, to solve the drawback light emitting diodes are often used in place of the lamps of the light source for illumination.

Since the pulse signal for the luminance adjustment which is supplied from the illuminance control circuit is generated based on the luminance change characteristics of the lamp as a reference, there are many inconveniences. For instance, if the light source is replaced with the light emitting diode, the degree of illuminance control and the change in luminance of the light emitting diode do not coincide. In another case, the luminance of the light emitting diode does not decrease too slowly or decreases suddenly in response to a dimming control.

OBJECTS AND SUMMARY OF THE INVENTION

The invention has been made to solve the inconveniences described above and it is an object of the invention to provide a luminance control circuit that can match its luminance change characteristics with those of a conventional lamp when light emitting diodes are used as a light source controlled by the illuminating circuit.

According to the invention, there is provided a light emitting diode driving circuit which comprises: control pulse signal generating means for generating a control pulse signal having a variable duty factor; a smoothing circuit for smoothing the control pulse signal to generate a control voltage; a driving circuit for generating a driving voltage according to the control voltage and supplying a forward current to the light emitting diode; and a switching circuit for interrupting the forward current of the light emitting diode in response to the control pulse signal.

DETAILED DESCRIPTION OF THE PREFERRED EMBODIMENTS

Figure 1:
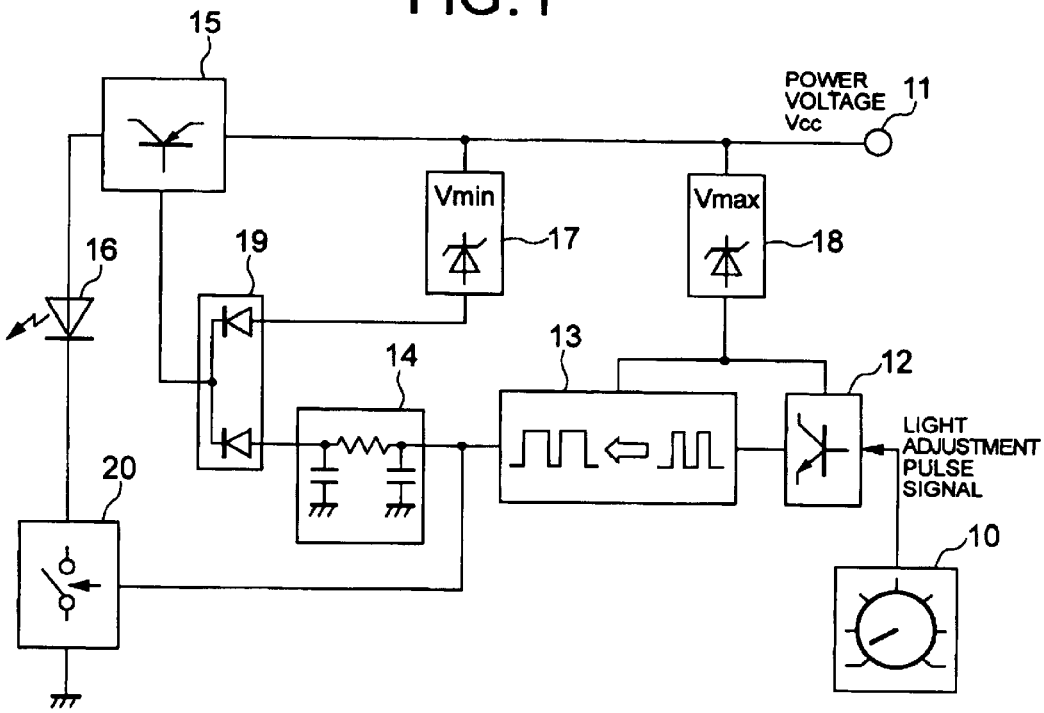
FIG. 1 is a block diagram showing the construction of an embodiment of a light emitting diode luminance control circuit according to the invention.

FIG. 1 is a block diagram showing an embodiment of a light emitting diode luminance control circuit according to the invention.

In FIG. 1, an illuminance control circuit 10 is provided for generating a light adjustment pulse signal to perform the luminance control of a light emitting diode.

A pulse amplitude stabilizing circuit 12 is a circuit for stabilizing an amplitude of the received light adjustment pulse signal. A pulse width adjusting circuit 13 is a circuit for changing a pulse time width of the pulse signal whose amplitude has been stabilized to a constant amplitude by the pulse amplitude stabilizing circuit 12 to a predetermined value.

A smoothing circuit 14 is a circuit for smoothing output pulses generated from the pulse amplitude stabilizing circuit 12 and generating a voltage proportional to a DC component included in the pulse signal.

A power voltage Vcc is supplied to a power input terminal 11 from a power source unit (not shown) of a vehicle. A constant voltage driving circuit 15 functions as a constant voltage source for supplying a predetermined forward current to a light emitting diode 16 as a load by using the power voltage.

The number of light emitting diodes 16 as a load is not limited to the number shown in the embodiment of FIG. 1. For example, it is also possible to combine a plurality of light emitting diodes serially or parallel and use them as a load of the constant voltage driving circuit 15.

A minimum voltage generating circuit 17 generates a control voltage Vmin from the power voltage Vcc, that is, the control voltage Vmin necessary for the constant voltage driving circuit 15 to supply a minimum forward current IFmin to the light emitting diode 16 as a load. IFmin denotes a forward current which is necessary for the light emitting diode 16 as a load to maintain the minimum luminance.

A maximum voltage generating circuit 18 is a circuit for generating a control voltage Vmax from the power voltage Vcc, that is, the control voltage Vmax necessary for the constant voltage driving circuit 15 to supply a forward current IFmax serving as a maximum luminance to the light emitting diode 16 as a load.

A control voltage switching circuit 19 is a circuit for switching an output voltage from the smoothing circuit 14 and an output voltage from the minimum voltage generating circuit 17 and supplying the switched output voltage to a control voltage input of the constant voltage driving circuit 15.

A forward current interrupting circuit 20 is operative to interrupt (switch) the forward current flowing in the light emitting diode 16 as a load in response to the pulses generated from the pulse width adjusting circuit 13.

The operation of the embodiment shown in FIG. 1 will be described below.

First, in the illuminance control circuit 10, a light adjustment pulse signal for performing the luminance control of the light emitting diode 16 is generated. Generally, the illuminance control circuit which is used for illuminating a console panel or the like of a vehicle is constructed by an extremely simple pulse generating circuit using an astable multivibrator. When the user rotates an illuminance adjustment knob provided for the illuminance control circuit 10, a duty factor of the light adjustment pulse signal which is generated from the circuit, that is, a relative time width between the "1 level" and the "0 level" of the pulse or a frequency of the light adjustment pulse signal changes.

The light adjustment pulse signal from the illuminance control circuit 10 is shaped into a pulse signal having a predetermined amplitude by the pulse amplitude stabilizing circuit 12. By performing the process, for example, even if the power voltage Vcc which is supplied from the vehicle fluctuates and the amplitude of the pulse signal from the illuminance control circuit 10 changes, it is possible to prevent the luminance of the light emitting diode 16 from fluctuating due to such fluctuation.

The pulse signal whose amplitude has been stabilized by the pulse amplitude stabilizing circuit 12 is supplied to the pulse width adjusting circuit 13. The circuit 13 is a circuit for adjusting the relative time width between the "1 level" and the "0 level" of the pulse signal. The adjustment of the time width is not uniformly determined but decided in dependence on characteristics of the light emitting diode 16 which is used in the circuit of the embodiment. That is, an adjustment is performed in a manner that the time width at the "1 level" in the pulse signal supplied to the circuit 13 is increased (or the time width at the "0 level" is reduced) in the case of a certain kind of light emitting diode. When using another kind of light emitting diode, the time width at the "1 level" in the pulse signal is reduced (or the time width at the "0 level" is increased).

The pulse signal in which the relative time width between the "1 level" and the "0 level" is adjusted to a desired value by the pulse width adjusting circuit 13 is subjected to a smoothing process by the smoothing circuit 14. The smoothing circuit 14 is constructed by an integrating circuit comprising a resistor and a capacitor. A DC voltage, therefore, which is proportional to a mean (integrated) value of the pulse signal from the pulse width adjusting circuit 13 appears in an output of the smoothing circuit 14.

The DC voltage as an output from the smoothing circuit 14 is supplied to the control voltage input terminal of the constant voltage driving circuit 15 via the control voltage switching circuit 19. The constant voltage driving circuit 15 functions as a constant voltage source which is controlled by the output voltage from the smoothing circuit 14 and supplies the forward current according to the constant voltage to the light emitting diode 16 as a load.

The higher the DC output voltage from the smoothing circuit 14 is, therefore, the more forward current flows into the light emitting diode 16, and the luminance of the light emitting diode 16 increases. The lower the DC output voltage from the smoothing circuit 14 is, the less forward current flows, and the luminance also decreases.

A process for smoothing the pulse signal as mentioned above is substantially equivalent to a process for integrating the pulse signal and obtaining its mean value, that is, a value of the DC voltage included in the pulse signal. When the time width of the "1 level" in the pulse signal is constant, therefore, the level of the DC voltage obtained by smoothing the pulse signal raises as the frequency of the pulse signal increases. Similarly, the value of the DC voltage obtained after the smoothing decreases as the frequency of the pulse signal decreases. When the frequency of the pulse signal is constant, the larger the time width of the "1 level" in the pulse signal is than that of the "0 level", the higher the value of the DC voltage obtained in the case of smoothing the pulse signal is.

As mentioned above, by rotating the illuminance adjustment knob of the illuminance control circuit 10, the duty factor of the light adjustment pulse signal which is supplied to the circuit in FIG. 1, that is, the relative time width between the "1 level" and the "0 level" of the pulse or a frequency of the light adjustment pulse signal changes. By the operation of the illuminance adjustment knob, therefore, the value of the DC output voltage from the smoothing circuit 14 changes and a luminance adjustment of the light emitting diode 16 is made.

In the embodiment, the relative time width between the "1 level" and the "0 level" of the pulse signal can be adjusted by the pulse width adjusting circuit 13 in accordance with the characteristics of the light emitting diode 16 as a load which is used. The motion of the illuminance adjustment knob, therefore, can be adapted to the luminance change of the light emitting diode 16 which is actually used.

At the stage of reducing the luminance of the light emitting diode 16 by the illuminance adjustment knob, naturally, the DC output voltage from the smoothing circuit 14 drops. In association with it, the forward current which is supplied from the constant voltage driving circuit 15 to the light emitting diode 16 decreases. According to the light emitting diode, generally, there is a tendency such that when the forward current is equal to or lower than a predetermined value, the luminance decreases suddenly. That is, assuming that the light emitting diode is used as a load, if the light amount is reduced by the illuminance adjustment knob, a phenomenon such that when the light amount is reduced to a level in a certain range, the luminance decreases suddenly occurs.

To prevent this inconvenience, even when the DC output voltage from the smoothing circuit 14 drops and the control voltage of the constant voltage driving circuit 15 drops, it is necessary to supply the minimum forward current IFmin for maintaining the minimum luminance to the light emitting diode 16 from the constant voltage driving circuit 15. For this purpose, in the embodiment, the minimum voltage generating circuit 17 is provided and generates the minimum control voltage Vmin which is necessary when the constant voltage driving circuit 15 supplies the current IFmin.

That is, in the embodiment shown in FIG. 1, when the DC output voltage from the smoothing circuit 14 drops to a value lower than the output voltage Vmin from the minimum voltage generating circuit 17, the voltage connected to the control voltage input of the constant voltage driving circuit 15 is switched from the output of the smoothing circuit 14 to the output of the minimum voltage generating circuit 17 by the diodes constructing the control voltage switching circuit 19. That is, by using the above construction, even if the output voltage of the smoothing circuit 14 drops to Vmin or lower, Vmin as an output voltage from the minimum voltage generating circuit 17 is always applied to the control voltage input of the constant voltage driving circuit 15. The supply of the forward current IFmin from the constant voltage driving circuit 15 to the light emitting diode 16 is, consequently, maintained and the light emitting diode 16 can hold the minimum luminance.

Figure 2:
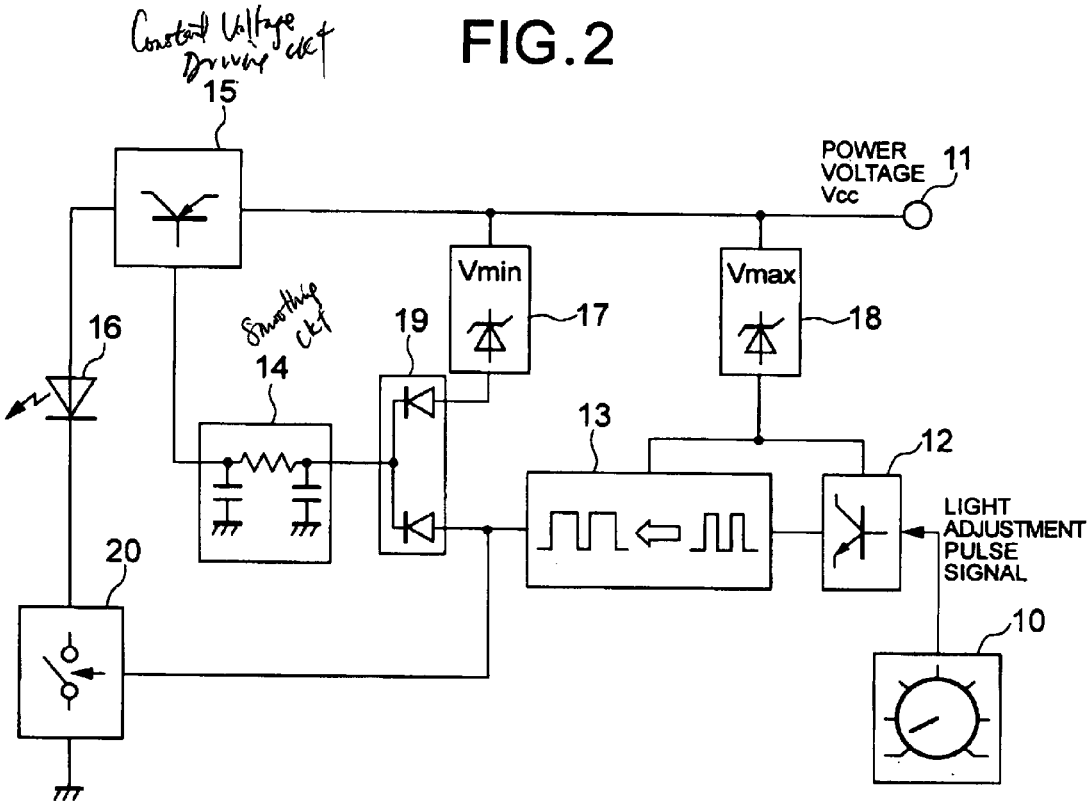
FIG. 2 is a block diagram showing a modification of the light emitting diode luminance control circuit shown in FIG. 1.

The switching position of the control voltage which is applied to the control voltage input of the constant voltage driving circuit 15 is not limited to a connecting position shown in FIG. 1. For example, the control voltage switching circuit 19 can be also provided for an input unit of the smoothing circuit 14 as shown in FIG. 2. In this case, between the pulse signal voltage which is supplied from the pulse width adjusting circuit 13 and the output voltage from the minimum voltage generating circuit 17, the voltage at a higher level is applied. That is, the voltage value Vmin from the minimum voltage generating circuit 17 is always applied to the control voltage input of the constant voltage driving circuit 15 and, in the voltage at the "1 level" of the pulse signal from the pulse width adjusting circuit 13, the voltage over Vmin is multiplexed to the voltage value Vmin.

The output pulse signal from the pulse width adjusting circuit 13 is also supplied to the forward current interrupting circuit 20. The circuit 20 is a circuit for switching the forward current flowing in the light emitting diode 16 synchronously with the pulse signal. By directly switching the forward current by the pulse signal, the forward current also becomes a pulse signal synchronized with the pulse waveform.

The mean value of the switched forward current, therefore, differs in accordance with the frequency of the pulse signal or the relative time width between the "1 level" and the "0 level" in the pulse signal. That is, the luminance adjustment of the light emitting diode 16 can be also made by the switching process by the forward current interrupting circuit 20.

The pulse signal which is supplied to the forward current interrupting circuit 20 is not limited to the output pulses from the pulse width adjusting circuit 13 but, for example, the light adjustment pulse signal from the illuminance control circuit 10 can be also directly used in accordance with the characteristics of the light emitting diode 16 which is used.

In the embodiment, the output voltage Vmax of the maximum voltage generating circuit 18 is used as a power voltage of the pulse amplitude stabilizing circuit 12 and pulse width adjusting circuit 13. Vmax corresponds to the control voltage which is needed by the constant voltage driving circuit 15 in order to supply the forward current by which the maximum luminance of the light emitting diode 16 can be obtained. Vmax is formed by a method whereby the maximum voltage generating circuit 18 stabilizes the power voltage Vcc which is supplied from a power source unit (not shown) of a vehicle.

As described above, according to the embodiment, as functional circuits regarding the luminance adjustment of the light emitting diode 16, in addition to the conventional smoothing circuit 14 and constant voltage driving circuit 15, mainly three functional circuits such as pulse width adjusting circuit 13, minimum voltage generating circuit 17, and forward current interrupting circuit 20 are provided. According to the luminance adjusting circuit of the invention, however, it is not always necessary to provide all of those three functional circuits. That is, by combining at least two of those three functional circuits in accordance with the characteristics of the light emitting diode which is actually used as a load, a luminance change of the light emitting diode which is approximate to that of the conventional lamp can be obtained.

Figure 3:
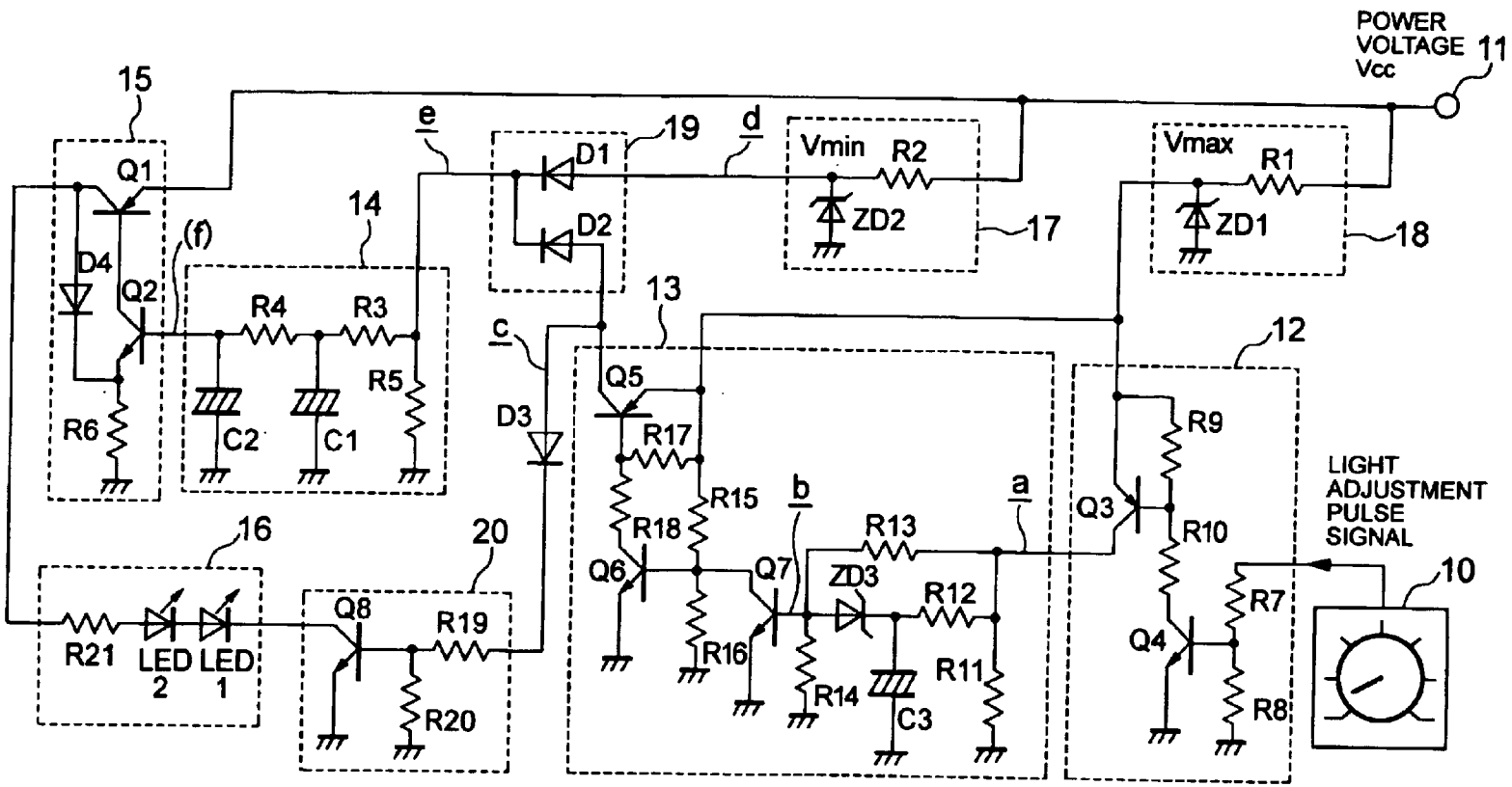
FIG. 3 is a circuit diagram showing a specific circuit construction of the block diagram shown in FIG. 2.

An example of a specific circuit construction regarding the embodiment is shown in FIG. 3.

In the circuit diagram of FIG. 3, to clarify the correspondence to the embodiment shown in FIGS. 1 and 2, circuit blocks (portions surrounded by broken lines in the circuit diagram of FIG. 3) corresponding to the functional circuits in FIGS. 1 and 2 are designated by the same reference numerals as those in the case of FIGS. 1 and 2. Since the illuminance control circuit 10 is an ordinary astable multivibrator circuit, its description is omitted.

Each circuit block in FIG. 3 will be explained hereinafter.

First, the pulse amplitude stabilizing circuit 12 comprises resistors R7 to R10 and transistors Q3 and Q4.

In the circuit 12, one end of the resistor R7 is connected to an output of the illuminance control circuit 10, and the other end of the resistor R7 is connected to a base of the transistor Q4 and one end of the resistor R8. A collector of the transistor Q4 is connected to one end of a serial circuit of the resistors R10 and R9 and the other end of the serial circuit is connected to an output of the maximum voltage generating circuit 18. The other end of the resistor R8 and an emitter of the transistor Q4 are connected to the ground. A base of a transistor Q3 is connected to a node of both resistors RIO and R9 in the resistor serial circuit thereof. An emitter of the transistor Q3 is connected to one end of the transistor Q9 in the resistor serial circuit and the output of the maximum voltage generating circuit 18. A collector of the transistor Q3 is used as an output to the pulse width adjusting circuit 13 at the next stage.

The pulse width adjusting circuit 13 comprises: resistors R11 to R18, transistors Q5 to Q7; a capacitor C3; and a Zener diode ZD3.

In the circuit 13, one end of each of the resistors R11 to R13 is connected to the collector of the transistor Q3 as an output of the pulse amplitude stabilizing circuit 12 at the front stage. The other end of the resistor R12 is connected to one end of the capacitor C3 and a cathode of the Zener diode ZD3. The other end of the resistor R13 is connected to an anode of the Zener diode ZD3, one end of the resistor R14, and a base of the transistor Q7, respectively. All of the other ends of the resistors R11 and R14 and capacitor C3 and an emitter of the transistor Q7 are connected to the ground.

A collector of the transistor Q7 is connected to one end of each of the resistors R15 and R16 and a base of the transistor Q6, respectively. The other end of the resistor R15 is connected to one end of the resistor R17, an emitter of the transistor Q5, and the output of the maximum voltage generating circuit 18, respectively. The other end of the resistor R17 is connected to one end of the resistor R18 and a base of the transistor Q5, respectively. The other end of the resistor R18 is connected to a collector of the transistor Q6. The other end of the resistor R16 and an emitter of the transistor Q6 are connected to the ground. A collector of the transistor Q5 is used as an output to the pulse width adjusting circuit 13.

The maximum voltage generating circuit 18 comprises a resistor R1 and a Zener diode ZD1. The resistor R1 and Zener diode ZD1 are serially connected and one end of the resistor R1 is connected to the power voltage Vcc. An anode of the Zener diode ZD1 is connected to the ground. Vmax as an output voltage of the maximum voltage generating circuit 18 is generated from a node of resistor R1 and Zener diode ZD1 (a cathode of the Zener diode ZD1).

The minimum voltage generating circuit 17 comprises a resistor R2 and a Zener diode ZD2. The resistor R2 and Zener diode ZD2 are serially connected and one end of the resistor R2 is connected to the power voltage Vcc. An anode of the Zener diode ZD2 is connected to the ground. Vmin as an output voltage of the minimum voltage generating circuit 17 is generated from a node of resistor R2 and Zener diode ZD2 (a cathode of the Zener diode ZD2).

The control voltage switching circuit 19 comprises diodes D1 and D2. Cathodes of those diodes are connected and a node thereof is used as an output of the control voltage switching circuit 19. An anode of the diode D1 is connected to an output of the minimum voltage generating circuit 17 (the cathode of the Zener diode ZD2). An anode of the diode D2 is connected to the collector of the transistor Q5 as an output of the pulse width adjusting circuit 13.

The smoothing circuit 14 locating at the next stage of the control voltage switching circuit 19 comprises resistors R3 to R5 and capacitors Cl and C2.

One end of each of the resistors R3 and R5 is connected to an output of the control voltage switching circuit 19. The other end of the resistor R3 is connected to one end of each of the resistor R4 and capacitor C1. The other end of the resistor R4 is connected to one end of the capacitor C2 and used as an output of the smoothing circuit 14. All of the other ends of the resistor R5 and capacitors C1 and C2 are connected to the ground.

The example of the specific circuit shown in FIG. 3 corresponds to the block diagram of FIG. 2 in which the positions of the smoothing circuit 14 and control voltage switching circuit 19 are opposite to those in the block diagram of FIG. 1. As mentioned above, however, the control voltage which is formed from the pulse signal and generated from the illuminance control circuit can be also compared with the minimum control voltage Vmin after the pulse signal was smoothed. According to the construction, the smoothing circuit 14 shown in FIG. 3 is provided between the pulse width adjusting circuit 13 and control voltage switching circuit 19.

The constant voltage driving circuit 15 comprises a resistor R6, transistors Q1 and Q2, and a diode D4.

The output of the smoothing circuit 14 at the front stage is connected to a base of the transistor Q2. A collector of the transistor Q2 is connected to a base of the transistor Q1. An emitter of the transistor Q2 is connected to one end of the resistor R6 and a cathode of the diode D4, respectively. The other end of the resistor R6 is connected to the ground. An anode of the diode D4 is connected to a collector of the transistor Q1 as an output of the constant voltage driving circuit 15. The power voltage Vcc is supplied to an emitter of the transistor Q1.

The light emitting diode 16 as a load shown in the block diagram of FIG. 1 comprises light emitting diodes LED 1 and LED2 and a resistor R21 in the specific circuit example of FIG. 3. In the circuit shown in FIG. 3, all of those devices are serially connected. One end of the resistor R21 is connected to the output of the constant voltage driving circuit 15. A cathode of the light emitting diode LED 1 is connected to the forward current interrupting circuit 20, which will be explained later.

As also mentioned in the detailed explanation in conjunction with FIG. 1, the number of light emitting diode devices and their connecting format are not limited to those shown in FIG. 3 but various connecting format can be used in accordance with characteristics of light emitting diodes being used, a value of the power voltage, and a desired luminance.

The forward current interrupting circuit 20 comprises resistors R19 and R20 and a transistor Q8.

One end of the resistor R19 is connected to the output of the pulse width adjusting circuit 13 through a diode D3. The other end of the resistor R19 is connected to one end of the resistor R20 and a base of the transistor Q8. The other end of the resistor R20 and an emitter of the transistor Q8 are connected to the ground, respectively. A collector of the transistor Q8 is connected to the cathode of the light emitting diode LED 1 as a load.

The operation in the example of the specific circuit shown in FIG. 3 will be described below.

The light adjustment pulse signal from the illuminance control circuit 10 is transferred to the pulse amplitude stabilizing circuit 12 and, thereafter, divided into proper voltage values by the resistors R7 and R8 and applied to the base of the transistor Q4. A circuit comprising the transistors Q3 and Q4 constitutes a switching circuit and interrupts the constant voltage Vmax supplied from the maximum voltage generating circuit synchronously with the input pulses. That is, even if the amplitude of the pulse signal from the illuminance control circuit 10 fluctuates, the "1 level" in the pulse signal is always stabilized to the amplitude of Vmax.

In the pulse width adjusting circuit 13, the output pulse from the pulse amplitude stabilizing circuit 12 is divided by the resistors R14 and R13 and applied to the base of the transistor Q7. The transistor Q7 is, therefore, turned on synchronously with the "1 level" of the input pulse signal. Since the input pulse signal is also applied to the serial circuit of the resistor R12 and capacitor C3, the capacitor C3 is charged to the voltage value Vmax corresponding to the amplitude of the "1 level" of the pulse signal through the resistor R12.

After that, even if the pulse signal changes from the "1 level" to the "0 level", an electric potential at the base of the transistor Q7 does not drop to the "0 level" immediately. This is because the base of the transistor Q7 is connected to one end of the capacitor C3 through the Zener diode ZD3 and the capacitor C3 is charged to the voltage value Vmax as mentioned above. That is, if a Zener voltage of the Zener diode ZD3 is equal to or lower than Vmax, the Zener diode ZD3 is conductive and the charged voltage of the capacitor C3 is applied to the base of the transistor Q7. Therefore, even if the input pulse signal to the pulse width adjusting circuit 13 changes from the "1 level" to the "0 level", the base potential of the transistor Q7 does not drop to the "0 level" immediately. The transistor Q7, consequently, is held in the ON state.

Since the charges accumulated in the capacitor C3 are discharged mainly through the resistors R12 and R11, the electric potential of the capacitor C3 decreases gradually. When the potential drops to the Zener voltage of ZD3 or lower, the connection between the capacitor C3 and the base of the transistor Q7 is disconnected. The base potential of the transistor Q7 is set to the "0 level" synchronously with the input pulse signal, and the transistor Q7 turns off.

A circuit comprising the resistors R15 to R18 and transistors Q5 and Q6 in a range from the collector of the transistor Q7 to the post stage constructs a waveform shaping circuit. A pulse waveform whose amplitude is equal to the voltage Vmax as an output from the maximum voltage generating circuit is generated from the collector of the transistor Q5 in response to ON/OFF of the transistor Q7.

That is, by providing a charging/discharging circuit including the capacitor C3 for the input unit of the pulse width adjusting circuit 13, the relative time width between the "1 level" and the "0 level" in the output pulse signal from the pulse amplitude stabilizing circuit 12 can be adjusted to a desired value.

Figure 4A:
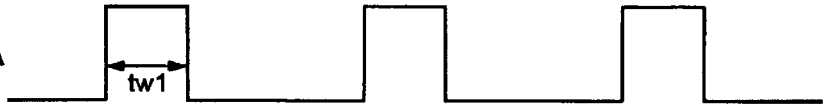
FIGS. 4A to 4C are time charts showing the adjusting operation of a pulse width in a pulse width adjusting circuit 13 in the circuit diagram shown in FIG. 3.
Figure 4B:
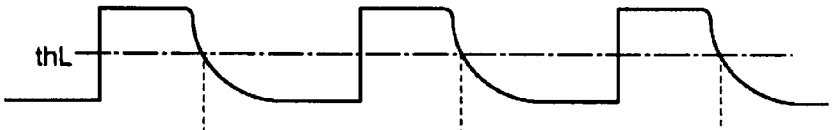
Figure 4C:
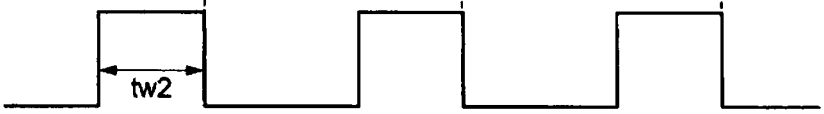

The processes in the pulse width adjusting circuit 13 described in detail above are shown in time charts of FIGS. 4A to 4C. FIGS. 4A to 4C show a voltage waveform at each point to which each of symbols (a) to (c) corresponds in the circuit diagram of FIG. 3. That is, FIG. 4A shows an input pulse waveform to the pulse width adjusting circuit 13. FIG. 4B shows a base potential of the transistor Q7 which changes slowly by the discharge of the capacitor C3. FIG. 4C shows an output pulse waveform from the pulse width adjusting circuit 13.

The one-dot chain line thL in FIG. 4B indicates a threshold level for discriminating the "1 level" and the "0 level" of the pulse signal in the waveform shaping circuit comprising the transistors Q5 and Q6. That is, if an amplitude level of the pulse waveform is larger than thL, the pulse of the "1 level" is generated from the pulse width adjusting circuit 13. If the amplitude level is equal to or smaller than thL, the pulse of the "0 level" is generated. As mentioned above, the time width of the "1 level" in the pulse signal transmitted to the pulse width adjusting circuit 13 is extended from tw1 to tw2 as shown in FIGS. 4A and 4C.

The time width of the pulse which is extended can be set to a desired value by adjusting a time constant of a discharging circuit comprising the resistors R12 and R11 and capacitor C3 or a value of each constant in the pulse width adjusting circuit 13 such as a Zener voltage value of the Zener diode ZD3 or the like.

In the case of the actual design of the circuit, the operation for shortening the time width of the "1 level" of the pulse signal in a manner opposite to that in the embodiment can be also easily realized by changing the construction and the connection of the charging/discharging circuit.

That is, in the embodiment, by selecting various constants and constructions as those of the charging/discharging circuit of the pulse width adjusting circuit 13 at the designing stage, the value of the duty factor d of the light adjustment pulses which are supplied from the illuminance control circuit 10 is converted by a function such as $f(d)=2d$ and can be used as a pulse signal of the duty factor that is optimum to the luminance control of the light emitting diode which is actually used as a load.

In the embodiment, although the pulse width adjusting circuit 13 has been constructed by independent circuit parts, it can be also realized by an integrated circuit including a microcomputer which is driven by a software program. In the case of using the construction as mentioned above, the kind of light emitting diode which is used as a load can be set by input means such as a dip switch. With the construction, the pulse signal suitable for the luminance control of the light emitting diode which is actually used can be also easily generated without changing the circuit elements and circuit pattern.

Each of the minimum voltage generating circuit 17 and maximum voltage generating circuit 18 is a constant voltage generating circuit using the Zener diode. According to those circuits, even if the power voltage Vcc which is applied to the serial circuit comprising the current limiting resistor R1 (R2) and the Zener diode ZD1 (ZD2) fluctuates, a constant Zener voltage is generated across the Zener diode owing to the constant voltage characteristics of the Zener diode. The Zener voltage of the Zener diode ZD1 corresponds to the maximum control voltage Vmax. The Zener voltage of the Zener diode ZD2 corresponds to the minimum control voltage Vmin.

The output voltage Vmax from the maximum voltage generating circuit 18 is supplied as a power voltage to the pulse amplitude stabilizing circuit 12 and pulse width adjusting circuit 13. The output voltage Vmin from the minimum voltage generating circuit 17 is supplied to the control voltage switching circuit 19, which will be explained later.

Between the voltages applied to the anodes of the diodes, the control voltage switching circuit 19 supplies the larger applied voltage to the cathode side which is connected in common by using switching characteristics of the diode.

As mentioned above, in the control voltage switching circuit 19, the output voltage Vmin from the minimum voltage generating circuit 17 is supplied to the anode of the diode D1. The output pulse signal from the pulse width adjusting circuit 13 is supplied to the anode of the diode D2. While the output pulse signal from the pulse width adjusting circuit 13 is at the "1 level", therefore, the voltage value Vmax appears on the common cathode side of the control voltage switching circuit 19 due to the relation of Vmax>Vmin. While the pulse signal is at the "0 level", the voltage value Vmin appears on the common cathode side due to the relation of Vmin>0.That is, in the case of the circuit shown in FIG. 3, the voltage waveform obtained by multiplexing the minimum control voltage Vmin to the output pulse signal from the pulse width adjusting circuit 13 appears as an output of the control voltage switching circuit 19.

Subsequently, the output of the control voltage switching circuit 19 is supplied to the smoothing circuit 14. The smoothing circuit 14 constructs a ladder type smoothing circuit (integrating circuit) comprising the resistors R3 to R5 and capacitors C1 and C2. The voltage waveform obtained by smoothing (integrating) the input voltage, that is, the DC voltage proportional to the mean value of the input voltage, therefore, appears as an output of the smoothing circuit 14.

In the output pulse signal from the pulse width adjusting circuit 13, therefore, the wider the width of the "1level" is or the higher the signal frequency is, the higher the mean voltage is, so that the output voltage of the smoothing circuit 14 increases and approaches the maximum control voltage Vmax. The narrower the width of the "1level" in the output pulse signal is or the lower the signal frequency is, the lower the mean voltage is, so that the output voltage of the smoothing circuit 14 decreases and approaches the minimum control voltage Vmin.

Figure 5A:
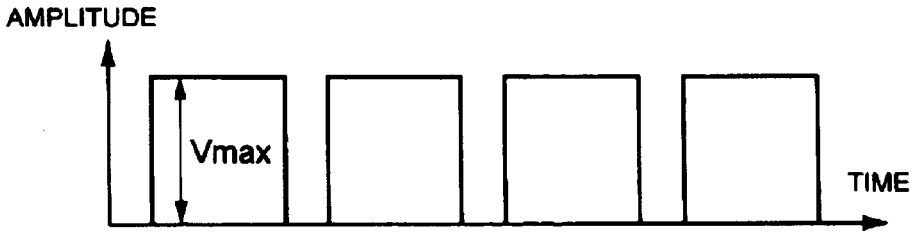
FIGS. 5A to 5D are time charts showing the operations of a control voltage switching circuit 19 and a smoothing circuit 14 in the circuit diagram shown in FIG. 3.
Figure 5B:
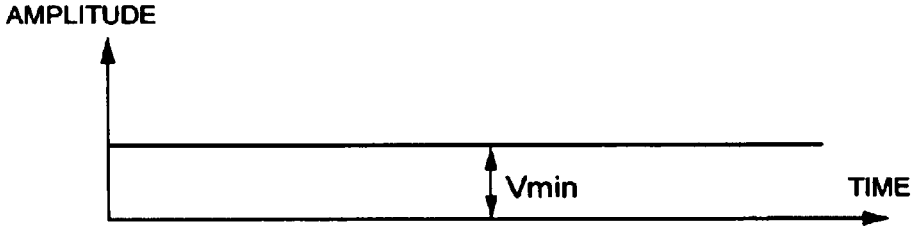
Figure 5C:
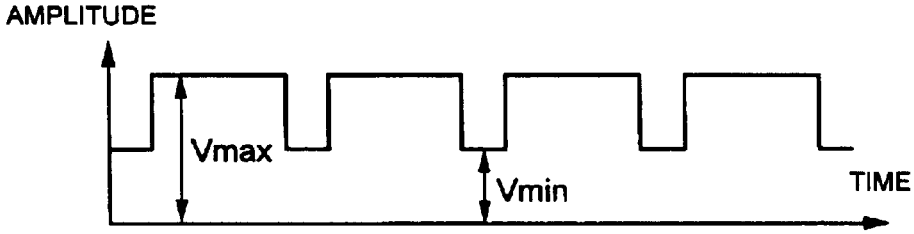
Figure 5D:
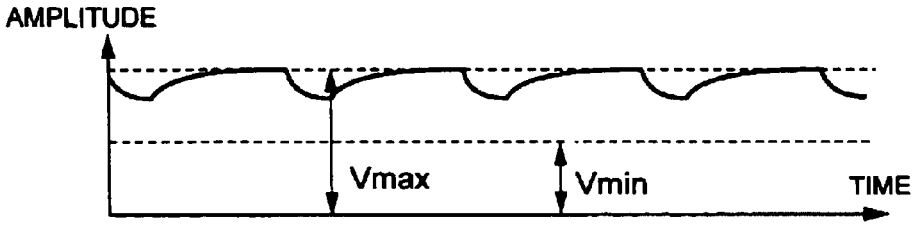

The operations of the control voltage switching circuit 19 and smoothing circuit 14 described in detail above are shown in time charts of FIGS. 5A to 5D. FIGS. 5A to 5D show a voltage waveform at each point to which each of symbols (c) to (f) in the circuit diagram of FIG. 3 corresponds. That is, FIG. 5A shows an output pulse waveform from the pulse width adjusting circuit 13. FIG. 5B shows the output voltage Vmin from the minimum voltage generating circuit 17. FIG. 5C shows the output voltage of the control voltage switching circuit 19. FIG. 5D shows the output voltage of the smoothing circuit 14.

The constant voltage driving circuit 15 is a constant voltage circuit comprising the transistors Q1 and Q2 and the like and generates a predetermined constant voltage from the power voltage Vcc. By the constant voltage, a predetermined forward current is supplied to the light emitting diodes 16 as a load serially connected to the constant voltage driving circuit 15.

The constant voltage which is generated by the constant voltage driving circuit 15 is controlled in accordance with the control voltage which is applied to the base of the transistor Q2. That is, when the constant voltage which is applied to the base of the transistor Q2 is equal to the maximum control voltage Vmax, the constant voltage which enables the forward current IFmax to flow is generated by the constant voltage driving circuit 15. In the case of the minimum control voltage Vmin, the constant voltage which enables the forward current IFmin to flow is generated.

The output pulse signal from the pulse width adjusting circuit 13 is also supplied to the forward current interrupting circuit 20 through the diode D3. In the forward current interrupting circuit 20, the pulse signal is divided by the resistors R19 and R20 and applied to the base of the transistor Q8. That is, the transistor Q8 repeats the ON/OFF state synchronously with the input pulse signal.

Since the light emitting diode 16 as a load is connected to the collector of the transistor Q8, the forward currents flowing in the light emitting diodes LED1 and LED2 are also interrupted by it.

As mentioned in the detailed description in the block diagram of FIG. 1, the pulse signal which is supplied to the forward current interrupting circuit 20 is not limited to the output from the pulse width adjusting circuit 13 but, for example, the light adjustment pulse signal from the illuminance control circuit 10 can be also directly used in accordance with the characteristics of the light emitting diode which is used.

As described in detail above, according to the invention, even when the light source for illumination such as a console panel is replaced with the light emitting diode from the lamp, the luminance change characteristics similar to those of the conventional lamp can be obtained under the illuminance control.

By using the light emitting diodes as a light source, the luminance control circuit and the devices which are used can be reduced in size and the life span of the light source can be extended.

The present application is based on Japanese Patent Application No. 2001-27776 which is herein incorporated by reference.

What is claimed is:

1. A light emitting diode driving circuit comprising:

a control pulse signal generator for generating a control pulse signal having a variable duty factor adjusted in dependence on characteristics of the light emitting diode;

a smoothing circuit for smoothing said control pulse signal to generate a control voltage; and a driving circuit for generating a driving voltage according to said control voltage and supplying a forward current to said light emitting diode.

2. A circuit according to claim 1, wherein said control pulse signal generator comprises:

a light adjustment pulse signal generating circuit for generating a light adjustment pulse signal of a variable duty factor; and a control pulse signal generating circuit for generating a control pulse signal by adjusting the duty factor of said light adjustment pulse signal in dependence on characteristics of said light emitting diode.

3. A circuit according to claim 2, further comprising:

a minimum control voltage generating circuit for generating a predetermined minimum control voltage; and a control voltage switching circuit for setting said minimum control voltage at said driving circuit in place of said control voltage when said control voltage drops to a predetermined value or lower.

4. A circuit according to claim 2, further comprising:

a switch circuit for interrupting the forward current of said light emitting diode in response to said control pulse signal.

5. A circuit according to claim 2, further comprising:

a switch circuit for interrupting the forward current of said light emitting diode in response to said light adjustment pulse signal.

6. A circuit according to claim 2, wherein said control pulse signal generating circuit comprises:

an integrated circuit which is driven by a software program.

7. A circuit according to claim 1, further comprising:

a minimum control voltage generating circuit for generating a predetermined minimum control voltage; and a control voltage switching circuit for setting said minimum control voltage at said driving circuit in place of said control voltage when said control voltage drops to a predetermined value or lower.

8. A circuit according to claim 1, further comprising:

a switch circuit for interrupting the forward current of said light emitting diode in response to said control pulse signal.

9. A light emitting diode driving circuit comprising:

a luminance controller that approximates the luminance change characteristics of a light emitting diode with the luminance change characteristics of a lamp, wherein said luminance controller further comprises:

a pulse width adjuster that adjusts a pulse time width of a pulse signal from an illuminance controller to generate an adjusted pulse signal;

a pulse amplitude stabilizer that stabilizes an amplitude of a pulse signal from the illuminance controller to provide a stabilized pulse control signal to said pulse width adjuster;

a smoothing circuit that smooths the adjusted pulse signal to generate a smoothed pulse signal;

a current interrupter that interrupts a supply of current to the light emitting diode in response to the adjusted pulse signal;

a control voltage switch that selects one of the smoothed pulse signal from the smoothing circuit and a minimum voltage from a minimum voltage generator, and a constant voltage driver that provides the supply of current to the light emitting diode in proportion to the selected signal from the control voltage switch.

10. The circuit of claim 9, wherein said luminance controller matches the a rate of change of luminance of the light emitting diode to approximate a rate of change of luminance of a lamp.

11. The circuit of claim 9, wherein said luminance controller further comprises:

a pulse amplitude stabilizer that stabilizes the amplitude of a pulse signal from the illuminance controller to provide a stabilized pulse control signal to said pulse width adjuster;

a current interrupter that interrupts a supply of current to the light emitting diode in response to the adjusted pulse signal;

a control voltage switch that selects one of the adjusted pulse signal and a minimum voltage from a minimum voltage generator, a smoothing circuit that smooths the selected signal to generate a smoothed signal; and a constant voltage driver that provides the supply of current to the light emitting diode in proportion to the smoothed signal.

12. The circuit of claim 9, wherein said luminance controller comprises a pulse amplitude stabilizer that stabilizes the amplitude of the pulse signal from the illuminance controller and wherein said pulse width adjuster adjusts the amplitude stabilized pulse signal from the pulse amplitude stabilizer.

13. The circuit of claim 9, wherein said luminance controller comprises a maximum voltage generator that generates a maximum voltage that corresponds to a current supply which provides a maximum luminance from the light emitting diode, said maximum voltage providing a protection against over-voltage fluctuations in a voltage providing power to said luminance controller.

14. The circuit of claim 9, wherein said luminance controller comprises a minimum voltage generator that prevents a sudden luminance decrease by said light emitting diode.

15. The circuit of claim 9, wherein said luminance controller comprises a smoothing circuit.

16. The circuit of claim 9, wherein said luminance controller comprises a control voltage switch.

17. The circuit of claim 9, wherein said luminance controller comprises a current interrupter that interrupts the supply of current to the light emitting diode in response to a pulse signal.

18. The circuit of claim 9, wherein said luminance controller comprises a control voltage generator that adjusts a current supply to the light emitting diode based upon the luminance change characteristics of a light emitting diode.

19. The circuit of claim 9, wherein said luminance controller adjusts a time width of a pulse control signal based upon the luminance characteristics of the light emitting diode.

20. The circuit of claim 19, wherein said luminance controller increases the pulse width of said pulse control signal.

21. The circuit of claim 9, wherein said luminance controller comprises at least two of:

a pulse width adjuster that adjusts a time width of a pulse signal based upon the luminance characteristics of the light emitting diode;

a minimum voltage generator that prevents a sudden luminance decrease by said light emitting diode; and a current interrupter that interrupts the supply of current to the light emitting diode in response to a pulse signal.

* * * * *